United States Patent [19]

Fujioka et al.

[11] Patent Number: 4,864,182

[45] Date of Patent: Sep. 5, 1989

[54] DRIVING CIRCUIT FOR THIN FILM EL DISPLAY DEVICE

[75] Inventors: Yoshihide Fujioka; Kazuo Shoji; Shigeyuki Harada; Toshihiro Ohba, all of Nara, Japan

[73] Assignee: Sharp Kabushiki Kaisha, Osaka, Japan

[21] Appl. No.: 141,261

[22] Filed: Jan. 6, 1988

[30] Foreign Application Priority Data

Jan. 6, 1987 [JP] Japan ..... 62-1506

[51] Int. Cl.[4] ..... G09G 3/30

[52] U.S. Cl. ..... 315/169.3; 315/169.2; 340/781; 340/811; 340/825.81

[58] Field of Search ..... 315/169.2, 169.3; 340/781, 811, 825.81

[56] References Cited

U.S. PATENT DOCUMENTS

| | | | |
|---|---|---|---|
| 4,070,663 | 1/1978 | Kanatani et al. | 340/811 X |
| 4,234,821 | 11/1980 | Kako et al. | 315/169.3 |
| 4,349,816 | 7/1982 | Miller et al. | 340/781 |
| 4,456,909 | 6/1984 | Takahara et al. | 340/781 |
| 4,488,150 | 12/1984 | Kanatani | 340/781 |
| 4,594,589 | 6/1986 | Ohba et al. | 340/805 |
| 4,622,590 | 11/1986 | Togashi | 358/241 |
| 4,633,141 | 12/1986 | Weber | 315/307 |
| 4,636,789 | 1/1987 | Yamaguchi et al. | 340/805 |
| 4,652,872 | 3/1987 | Fujita | 340/781 |
| 4,686,426 | 8/1987 | Fujioka et al. | 315/169.3 |
| 4,707,692 | 11/1987 | Higgins et al. | 315/169.3 X |

FOREIGN PATENT DOCUMENTS

| | | | |
|---|---|---|---|
| 2149182 | 6/1985 | United Kingdom | 340/781 |

*Primary Examiner*—Donald J. Yusko
*Assistant Examiner*—Michael Horabik
*Attorney, Agent, or Firm*—Birch, Stewart, Kolasch & Birch

[57] ABSTRACT

A thin film EL display device wherein an EL layer is interposed between scanning side electrodes and data side electrodes which are arranged to cross one another. A data side driver IC, including switching elements for charging and discharging, is connected to the data side electrodes, and switching circuits for applying modulation voltage are connected to a pull-up common line of the data side driver IC. The switching circuits are provided with switches for removing the charge stored in the thin film EL device after the thin film EL device has emitted light and a capacitor for storing the removed charge, whereby the charge stored in the capacitor can be reused in the next light emission for the purpose of reducing power consumption.

17 Claims, 5 Drawing Sheets

DRIVING CIRCUIT FOR THIN FILM EL DISPLAY DEVICE

BACKGROUND OF THE INVENTION

1. Field of the Invention

This invention relates to a driving circuit for an alternating current drive type of capacitive flat matrix display panel, that is a driving circuit for a thin film EL (electroluminescent) display device.

2. Description of the Prior Art

As an example, a double insulation type or triple layer, structure thin film EL device is composed as follows.

As shown in FIG. 5, transparent electrodes 2 which are made from $In_2O_3$, and which are formed in a band shape are provided on a glass substrate 1 in parallel to each other. On these transparent electrodes 2, a dielectric material 3 such as $Y_2O_3$, $Si_3N_4$, $Al_2O_3$, an EL layer 4 made of ZnS in which an activator such as Mn is doped, and a dielectric material 3' such as $Y_2O_3$, $Si_3N_4$, $TiO_2$ or $Al_2O_3$ are respectively formed in thin films of 500 to 10000 A thickness successively applied by a thin film technology such as vapor deposition or sputtering to form three layers. Thereafter band-shaped back plates 5 made of $Al_2O_3$ are formed in parallel over the three layers in the direction perpendicular to that of the transparent electrodes 2.

Since the above thin film EL device is formed in such a manner that the EL material 4 sandwiched in between the dielectric materials 3 and 3' is interposed between the electrodes, it can be considered as a capacitive device from the view point of circuit equivalency. As can be clearly seen from FIG. 6 in which voltage-brightness characteristics are shown, the thin film EL device is driven by a relatively high level voltage substantially equal to 200 V. The thin film EL device has the capacity to emit bright light due to its a.c. electric field and exhibits a long life.

In order to decrease power consumption in at the modulation drive system of a display device in which a thin film EL device of the type described above is used, the applicant of the present invention has previously proposed a driving device comprising a scanning side driver IC as a driving circuit for scanning side electrodes. The scanning side driver IC comprises transistors which apply negative voltage to data side electrodes and transistors which apply positive voltage to the same. On the other hand, in order to serve as a driving circuit for the data side electrodes, the driving device comprises a data side driver IC which has transistors for charging the EL layer up to the modulation voltage, transistors for discharging the EL layer, and diodes each connected in the inverse direction to the direction of electric current flow of the corresponding transistors. With the structure described above, modulation drive may be performed on the data side with the use of the charging and discharging transistors driven by display data. On the other hand, on the scanning side, field reverse drive is performed with the use of N-ch transistors and P-ch transistors. Furthermore, successive drive of scanning lines may be performed with the polarities of a writing waveform applied to picture elements reversed every other scanning line. As a result of this application of symmetrical write pulses with opposed polarities, a reliable driving device is obtained that exhibits the capacity to horizontally scan one line within a short time, and to apply alternating pulses of good symmetry to the EL layer (see, for example, Unexamined Japanese Patent Publication No. SHO 61-282895) corresponding to Ser. No. 864,509.

Since the above mentioned driving device comprises, as shown in FIG. 4(*a*), a charge side transistor UT of the data side driver IC which is made of a bipolar type of NPN transistor, no electric current is conducted from a common line Vcc to the charge side transistor UT when the charge side transistor UT is switched off. However, as shown in FIG. 4(*b*), current flow will occur only in a case where the data side electrode is negative.

The reason why this current flow occurs is that although the base potential of the charge side transistor UT is zero in the data side driver IC to make this transistor nomenclature, a parasitic diode disposed between the base and the emitter is biased in the forward direction when the potential of the data side electrode is negative because the transistor is of the NPN type. As a result of this, the base current flows to cause the transistor UT to be turned on, thereby allowing a collector current to flow. The data side electrode inevitably becomes negative because the thin film EL display device needs to be driven in an alternating current manner. Therefore, if the thin film EL display device is driven by a conventional driver IC, an excessive amount of current will be lost.

Furthermore, in conventional drive circuits, the electrical charge which has been accumulated in the thin film EL display device is fully consumed by resistance factors within the driving circuit at the time of discharge. As described above, since an active type (self-luminescent type) of display basically consumes a large amount of electricity, it is desired to decrease the electricity consumption.

SUMMARY OF THE INVENTION

According to the present invention, in a driving circuit for a thin film EL display device wherein an EL layer is disposed between orthogonally disposed scanning side electrodes and data side electrodes, the driving circuit comprises; scanning side driver ICs which are formed by switching elements for applying positive voltage to the scanning side electrodes and switching elements for applying negative voltage to the same, and switching circuits for selectively applying writing voltage or 0 V to a common line of the scanning side driver ICs; a data side driver IC formed by switching elements for charging and switching elements for discharging connected to the data side electrodes, and switching circuits for applying modulation voltage connected to a pull-up common line of the data side driver ICs; the switching circuits connected to the data side driver IC being provided with switches for removing charge stored in the thin film EL display device after the thin film EL device has emitted light and a capacitor for storing the removed charge.

An object of the present invention is to provide a driving circuit for a thin film EL display device in which electricity consumption in modulation driving can be dramatically reduced by way of charging an external capacitor with a portion of the charge in the display device and reusing the charge in the next modulation drive.

DESCRIPTION OF THE PREFERRED EMBODIMENT

Referring to the accompanying drawings, an embodiment of the present invention will now be described in detail.

Figure 1:
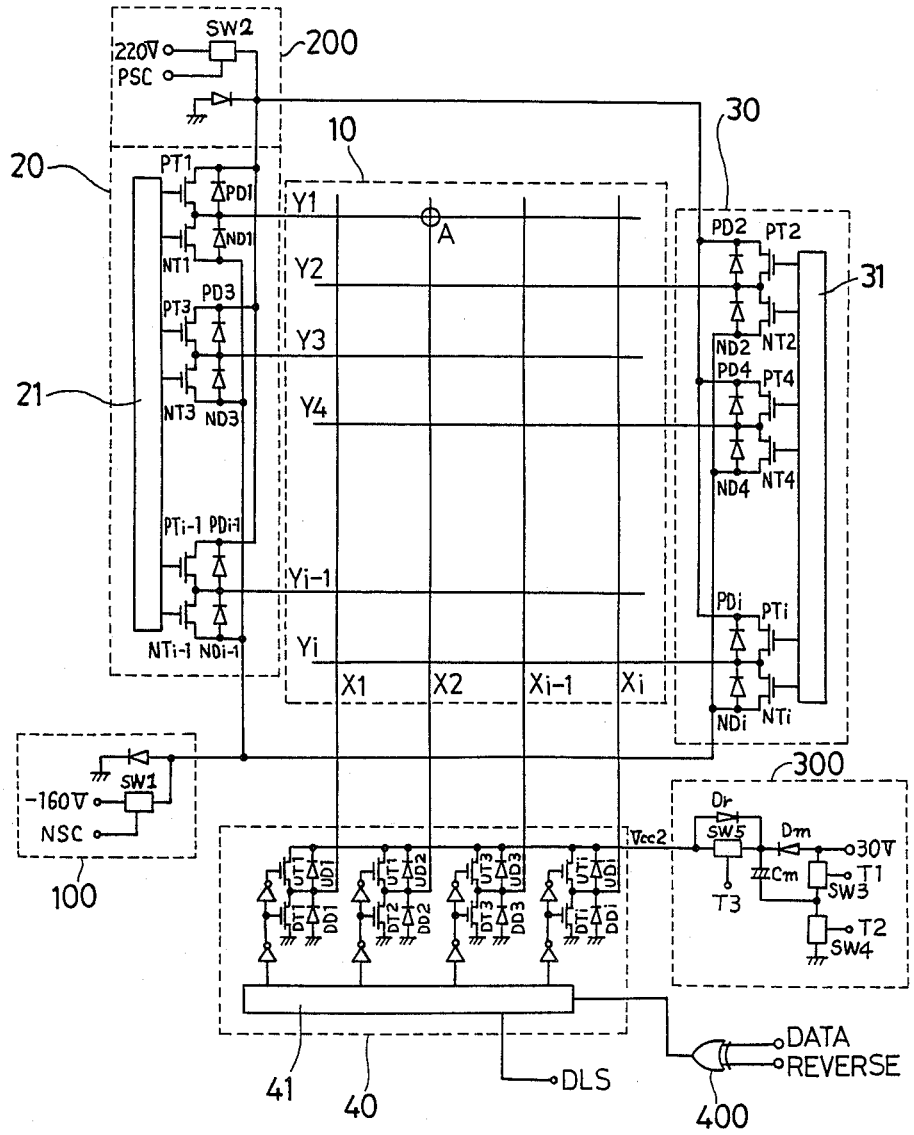
FIG. 1 is a view showing a driving circuit for a thin film EL display device according to an embodiment of the present invention.

FIG. 1 is a view illustrating the structure of a driving circuit according to an embodiment of the present invention.

Reference numeral 10 represents a thin film EL display device having a luminescence threshold of 190 V (Vw). As shown in FIG. 1, electrodes in the X-direction are arranged to be data side electrodes, while electrodes in the Y-direction are arranged to be scanning side electrodes, and only the electrodes are illustrated.

Reference numerals 20 and 30 represent scanning side high voltage driver ICs (equivalent to a first switching circuit and abbreviated "scanning side driver IC" hereinafter) which respectively correspond to the electrodes of odd number lines and even number lines in the Y-direction of the above thin film EL display device. Transistors NTodd for applying negative voltage to the data side electrodes and transistors PTodd for applying positive voltage to the same are connected to the odd number lines. Diodes NDodd and PDodd which pass an electric current in the inverse direction to their corresponding transistors are connected thereacross. On the other hand, transistors NTeven for applying negative voltage to the data side electrodes and transistors PTeven for applying positive voltage to the same are connected to the even number lines. Diodes NDeven and PDeven for passing electric current in the inverse direction are connected to each of the transistors NPeven and PTeven. Reference numerals 21 and 31 are logical circuits such as shift registers in the above scanning side drivers IC20 and IC30.

Reference numeral 40 represents a data side high voltage driver IC (equivalent to a second switching circuit, and abbreviated to "data side driver IC" hereinafter) which corresponds to electrodes in the X-direction of the above thin film EL display device 10. Each of the lines in the X-direction is connected to switching elements $UT_1$ to $UT_i$ (abbreviated to "transistor" hereinafter) such as a Pch-MOSFET, a thyristor or a PNP-transistor, whose one side is connected to a modulation power source. The switching elements $UT_1$ to $UT_i$ have a pull-up function. Each of the lines is further connected to switching elements $DT_1$ to $DT_i$ (abbreviated to "transistor" hereinafter) such as a Nch-MOSFET, a thyristor or a NPN-transistor whose one side is grounded, and which has a pull-down function. The lines further comprise diodes $UD_1$ to $UD_i$ and $DD_1$ to $DD_i$ for respectively passing electric current in the reverse direction to the corresponding transistors UT and DT. Each of the above elements is controlled by a logical circuit 41 such as a shift register in the data side driver IC40.

Reference numeral 100 represents a circuit (equivalent to a third switching circuit) for switching the potential of a common pull-down line of the scanning side drivers IC20 and IC30. This circuit 100 comprises a switch SW1 for switching the potential between negative writing voltage $-160$ V ($-Vw+\frac{1}{2}Vm$) and 0 V in response to a control signal NSC.

Reference numeral 200 represents a circuit (equivalent to a fourth switching circuit) for switching the potential of a common pull-up line of the scanning side drivers IC20 and IC30. The circuit 200 comprises a switch SW2 for switching the potential between positive writing voltage 220 V ($Vw+\frac{1}{2}Vm$) and 0 V in response to a control signal PSC.

Reference numeral 300 represents a circuit (equivalent to a fifth switching circuit) for charging a capacitor Cm with $\frac{1}{2}$ modulation voltage of 30 V ($\frac{1}{2}Vm$) by way of switching on a switch SW4 in response to a control signal T2. After the capacitor Cm has been charged, the circuit 200 acts to supply modulation voltage of 60 V (Vm) to the data side driver IC40 by way of switching off a switch SW4 in response to a control signal T2, and switching on of switches SW3 and SW5 in response to control signals T1 and T3. The circuit 300 is connected to the data side driver IC40 through a switch SW5 which is under control of the control signal T3. Furthermore, the circuit 300 also serves as a circuit for storing charge in the above capacitor Cm through a diode Dr, of which charge corresponds to a part of energy stored in the above thin film EL display device 10. The above charging action is conducted by switching on switch SW4 in response to the control signal T2 after the thin film EL display device has emitted light.

Reference numeral 400 represents a data reverse control circuit which comprises an Exclusive-OR gate (XOR).

The operation of the circuit shown in FIG. 1 will now be described with reference to FIG. 2 in which a time chart is shown.

A scanning electrode $Y_1$ including a picture element A is arranged to be selected as a selected scanning electrode in the successive driving of the lines.

In this driving device, the polarity of writing voltage applied to picture elements is reversed every line. In this device, the drive timing for one line for turning on only the pull-down transistor NTn of the scanning side drivers IC20 and IC30 which are connected to the scanning side selected electrode and applying a negative writing pulse to the picture elements on an electrode line of the pull down transistor NTn is called an N-drive timing. Meanwhile, the drive timing for one line for turning on only the pull-up transistor PTn of the scanning drivers IC20 and IC30 which are connected to the selected electrode and applying a positive writing pulse to the picture element on an electrode line of the pull-up transistor PTn is called a P-drive timing.

On the data side, in principle, drive is conducted by switching the voltage applied to each data side line at a horizontal period between Vm and 0 V in accordance with display data "DATA".

The switching timing will now be described.

Figure 2:
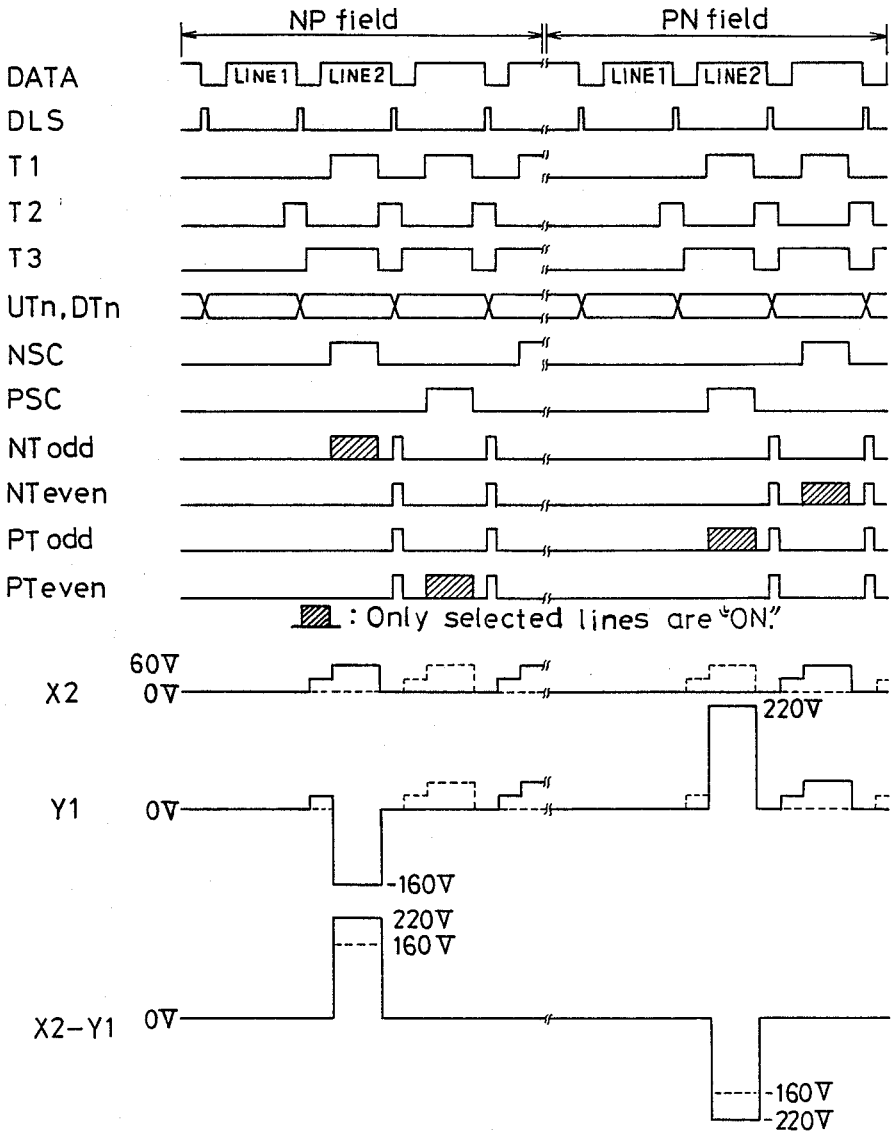
FIG. 2 is a timing chart illustrating an operation of the circuit shown in FIG. 1.

As shown in FIG. 2, after data for one line has been transferred, data is latched with a control signal DLS. By means of this latched data item, the transistors UT and DT of the data side driver IC40 are controlled to turn on or off. As the characteristic of this device, if the transistor UTn is turned on, the modulation voltage Vm is not immediately applied, the charging from the potential of $\frac{1}{2}$ Vm to Vm is carried out in a step manner by means of the fifth switching circuit 300. AS the result of this, stepwise driving consumption of electric power used for modulation is reduced to three quarter and a portion of the charge accumulated in the EL layer is transferred to the exterior capacitor Cm through the diode Dr when the potential is $\frac{1}{2}$ Vm. The stored charge is reused as a part of driving energy when the modulation voltage Vm is then added. AS a result of this, electric power consumption used for modulation is further reduced.

The operation of the driving circuit is mainly constituted by two types of timing consisting of an NP-field and a PN-field. By completion of the execution of the two fields, alternating current pulses which are needed for emitting light fully offset each other for all of the picture elements of the thin film EL display device. Furthermore, each of the fields (frames) is constituted by two types of timing consisting of N-drive and P-drive. In the NP-field, the N-drive is performed in the odd numbers selected lines on the scanning side, while P-drive is performed in the even numbers selected lines. In the PN-field, the drive is inversely performed. Furthermore, the N-drive and P-drive respectively include a charge period and a writing period.

Then, the driving period will now be described.

(A) NP-field

1. Charge period in N-drive ($TN_1$)

The switches SW1 and SW2 are turned off in response to the control signals NSC and PSC allowing the common line to be 0 V. Then, all of the transistors NT and PT of the scanning side drivers IC20 and IC30 are turned off, whereby all of the electrodes on the scanning side are brought into a floating state. In this state, on the data side, by turning off the switches SW3 and SW5 in response to the control signals T1 and T3 and turning on the switch SW4 in response to the control signal T2, the modulation power source Vcc2 is brought into the floating state, and a portion of the charge accumulated in the EL layer is transferred to the capacitor Cm through the diode Dr. The charge is also supplied from $\frac{1}{2}$ Vm power source through the diode Cm to the EL layer. Then, when a control signal DLS is supplied, the transistors UT and DT of the data side driver IC40 are switched. Simultaneously, by turning on all of the scanning side transistors PT and NT, the charge of the El layer is discharged causing the potential of the electrode on the scanning side to become 0 V. When the switch SW4 is turned off in response to the control signal T2 and the switch SW5 is turned on in response to the control signal T3, the potential of the electrode which is connected to the selective picture element on the data side becomes $\frac{1}{2}$ Vm.

2. Writing period in N-drive ($TN_2$)

The transistors NTn of only those drives which are connected to the selected scanning electrode are turned on and the other transistors NT and PT of the scanning side drivers IC20 and IC30 are turned off. Simultaneously, 0 V is added to the common pull-up line of the scanning side drivers IC20 and IC30 with the switch SW2 turned off in response to the control signal PSC. A negative writing voltage ($-Vm+\frac{1}{2}$ Vm) is added to the common pull down line of all of the scanning side drivers IC20 and IC30 by way of turning on of the switch SW1 in response to the control signal NSC. On the other hand, the data side driver IC40 remains in operation during the discharge period (TN1) due to the above N-drive. The above fifth switching circuit 300 turns on the switch SW3 in response to the control signal T1 causing the potential of the modulation power source Vcc2 to be raised to Vm.

As a result of this, the potential of the data side electrodes including the picture elements becomes Vm. Simultaneously, $Vm-(-Vw+\frac{1}{2}Vm)=Vw+\frac{1}{2}Vm$ is added to the selected picture elements causing light emission because the negative writing voltage $-Vw+\frac{1}{2}$ Vm is added to the selected scanning electrodes. Although $0\ V-(-Vw+\frac{1}{2}Vm)=Vw-\frac{1}{2}Vm$ is added to the non-selected picture elements because the data side electrode potential is 0 V and negative writing voltage of $-Vw+\frac{1}{2}$ Vm is added to the selected scanning electrodes, they do not emit light because the luminescence threshold Vw is not reached.

The picture elements on the scanning side non-selected electrode lines are changed in its potential from 0 V to 60 V in accordance with the proportion between the data side selected electrode and non-selected electrode because the scanning side electrodes are in the floating state.

3. Discharge period in P-drive ($TP_1$)

The same drive as that carried out in the discharge period due to the NP-field N-drive ($TN_1$) is conducted except the transistors UT and DT of the data side driver IC40 are turn on or off in accordance with the reverse data of the display data caused by the state change of the REVERSE signal.

4. Writing period in P-drive ($TP_2$)

The transistor PTn of only the drivers connected to the selected scanning side electrodes are turned on, while the transistors UT and PT of the other scanning side drivers IC20 and IC30 are turned off. Simultaneously, the positive writing voltage of $Vw+\frac{1}{2}$ Vm is added to the pull-up common line of the scanning side drivers IC20 and IC30 by way of turning on of the switch SW2 in response to the control signal PSC. Meanwhile, 0 V is added to the pulldown common line of the scanning side drivers IC20 and IC30 turning off of the switch SW1 in response to the control signal NSC. On the other hand, the data side driver IC40 remains operative during the discharge period ($TP_1$) in the P-drive. AS a result of the operation of the fifth switching circuit 300 the switch SW3 is turned on in response to the control signal T1 causing the potential of the modulation power source Vcc2 to be raised to Vm.

As a result of this, the potential of the data side electrodes including the selected picture elements becomes 0 V. Simultaneously, since the positive writing voltage of $Vw+\frac{1}{2}$ Vm is added to the selected scanning side electrodes, $(Vw+\frac{1}{2}Vm)-0\ V=Vw+\frac{1}{2}Vm$ is added in an inverse polarity manner as the writing voltage in the N-drive to the selected picture elements, and thus light is emitted. Although a positive writing voltage $Wv+\frac{1}{2}$ Vm is added to the selected scanning side electrodes, and thereby $(Vm+1.2\ Vm)-Vm=Vw-\frac{1}{2}Vm$ is added to the non-selected picture elements, light is not emitted because the luminescence threshold Vw is not reached.

(B) PN-field

5. Discharge period in P-drive ($TP_3$)

The same drive as that in the discharge period ($TP_1$) in NP-field P-drive is conducted.

6. Writing period in P-drive ($TP_4$)

The same drive as that carried out in the writing period ($TP_2$) in NP-field P-drive is conducted except the scanning side electrodes are selected from the odd numbers side.

7. Discharge period in N-drive ($TN_3$)

The same drive as that carried out in the discharge period ($TN_1$) in NP-field N-drive is conducted.

8. Writing period in N-drive ($TN_4$)

The same drive as that carried out in the writing period ($TN_2$) in NP-field N-drive is conducted except the scanning side electrodes are selected from the even numbers side.

In a conventional driving circuit, the charge caused from the writing voltage which has been stored in the EL display device after emitting light is discharged through the resistance elements in the driving circuit. However, in the driving circuit according to this embodiment, a driving circuit in which the modulation charge can be reused is employed. As a result of this, electricity consumption of the modulation drive can be reduced by 50% in comparison to the conventional driving circuit in which the modulation charge is discharged.

The reason for this reduction will now be described with reference to FIG. 3 in which models of the circuit are illustrated.

Figure 3A:
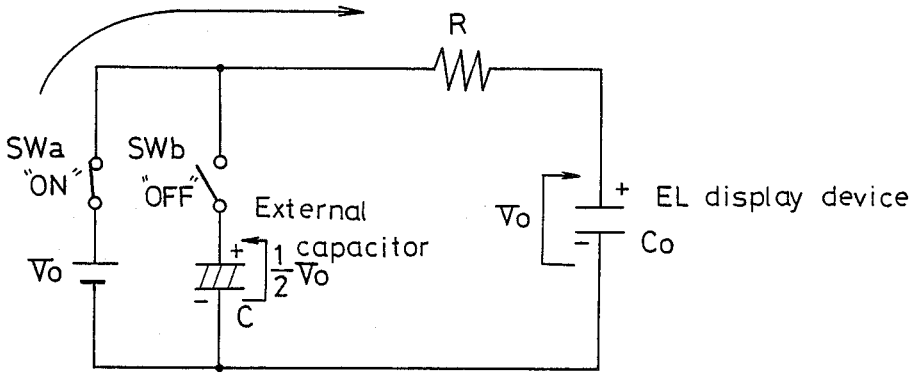
FIGS. 3(*a*) and 3(*b*) show models of a modulation driving circuit.
Figure 3:
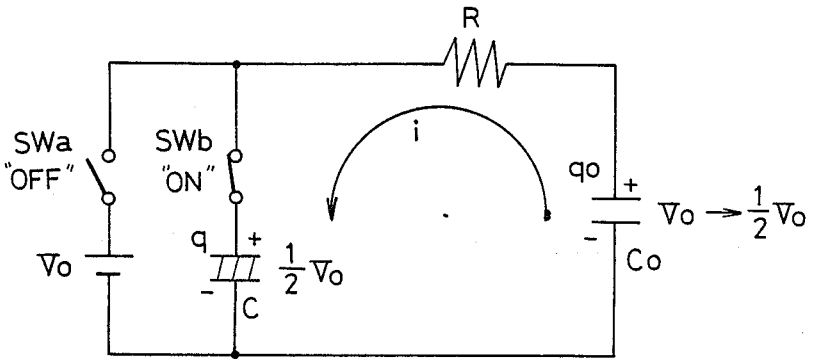
Figure 4A:
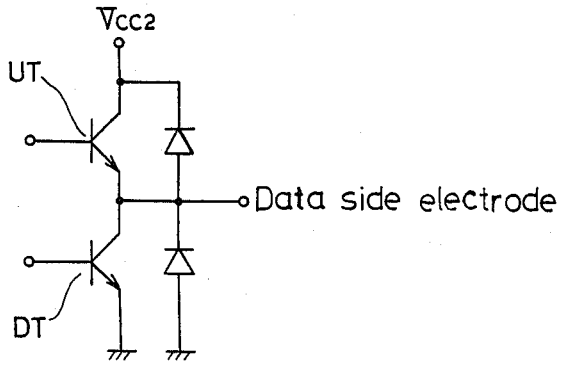
FIG. 4(a) (PRIOR ART)
FIGS. 4(*a*) and 4(*b*) show circuits for an output step of a conventional data side driver IC.
Figure 4:
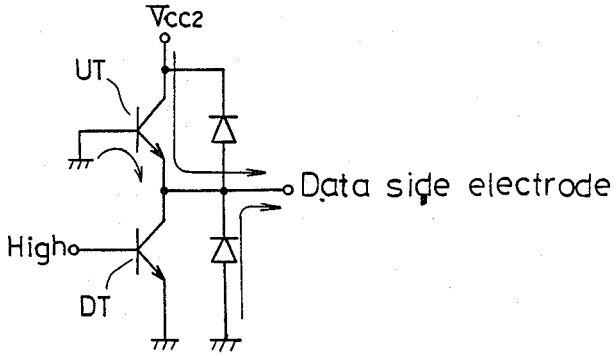
Figure 5:
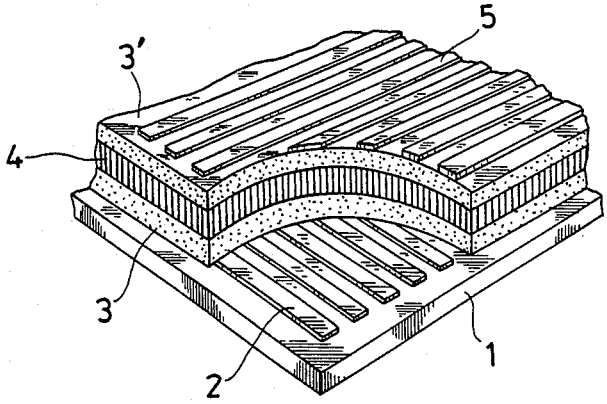
FIG. 5 is a perspective view, from which a part is omitted, of a thin film EL display device.
Figure 6:
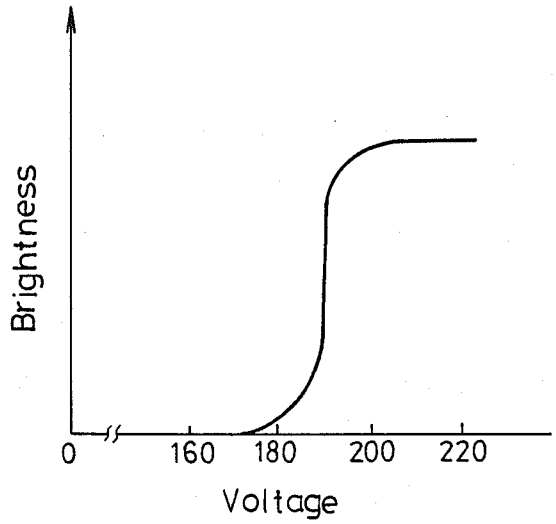
FIG. 6 is a view showing the relationship between the applied voltage and brightness of a thin film EL display device.

FIG. 3(*a*) shows a state in which the EL display device (capacity Co) is charged with a voltage of Vo (equivalent to Vm in the embodiment) by way of turning on of a switch SWa. In FIG. 3(*a*), R represents a resistance in the driving circuit. In this state, the amount of energy stored in the EL display device becomes $\frac{1}{2}$ $CoVo^2$, while the amount of energy consumed by the resistance R becomes $\frac{1}{2}$ $CoVo^2$. In this state, the amount of energy transferred from the EL display device to the external capacitor C can be examined in the equilibrium which is realized by turning off of a switch SWa and turning on of a switch SWb. Then, provided that the charge of $\frac{1}{2}$ CVo has been previously charged in the external capacitor C (however, C>>Co), the electric current passing through the circuit is i, the charge stored in the EL display device CO is qo, and the charge stored in the external capacitor C is q, whereby $$qo = CoVo, \text{ when } t = 0 \quad (1)$$

$$q = \tfrac{1}{2}CVo \quad (2)$$

$$i = \frac{dq}{dt} = -\frac{dqo}{dt} \quad (3)$$

are held, therefore, from equations (1), (2), and (3), $$qo = -q + Vo\,(\tfrac{1}{2}C + Co) \quad (4)$$

is obtained. Meanwhile, from the circuit equation, $$R{\cdot}i + q/C - qo/Co = 0 \quad (5)$$

is held, and therefore, substituting equations (3) and (4) for equation (5), the solution of the resulting differential equation is obtained as follows.

$$q = \frac{VoC(C + 2Co)}{2(C + Co)} - \frac{VoCCo}{2(C + Co)} \cdot e^{-\frac{C+Co}{CCoR}t}$$

Therefore, from equation (3), $$i = \frac{dq}{dt} = \frac{Vo}{2R} \cdot e^{-\frac{C+Co}{CCoR}t}$$

and energy PR consumed by resistance R becomes $$PR = \int_o^t i^2 R\,dt = \frac{Vo^2CCo}{8(C + Co)} \cdot (1 - e^{-\frac{C+Co}{CCoR}t})$$

when $t \rightarrow \infty$, $$PR = \frac{Vo^2CCo}{8(C + Co)} \approx \tfrac{1}{8}CoVo^2 \quad (C >> Co)$$

Residual energy in the EL display device becomes as follows because the voltage at both ends of the EL display device becomes $\frac{1}{2}$ Vo, $$\tfrac{1}{8}Co\left(\frac{Vo}{2}\right)^2 = \tfrac{1}{8}CoVo^2.$$

Therefore, energy Pe (recovery evergy) transferred from the EL display device Co to the external capacitor C becomes:

$$\begin{aligned} Pe &= (\text{energy stored in the } EL \text{ display device } Co) - \\ &\quad (\text{energy residual in the } EL \text{ display device } Co) - \\ &\quad (\text{energy consumed in the external resistance } R) \\ &= \tfrac{1}{2}CoVo^2 - \tfrac{1}{8}CoVo^2 - \tfrac{1}{8}CoVo^2 \\ &= \tfrac{1}{4}CoVo^2 \end{aligned}$$

Therefore, in the driving circuit according to the present embodiment, since charge which is obtained when the modulation voltage is applied in a step manner as $\frac{1}{2}$ Vm and Vm at charge and when the external capacitor C is stored at discharge, is reused, the EL layer needs the amount of energy as follows.

$$\tfrac{1}{4}Covo^2 + \tfrac{1}{4}Covo^2 = \tfrac{1}{2}CoVo^2$$

While, the conventional EL display device Co needs at charge and discharge the amount of energy as follows.

$$\tfrac{1}{2}CoVo^2 + \tfrac{1}{2}CoVo^2 = CoVo^2$$

Accordingly, the consumption is reduced by 50%.

Furthermore, since the pull-up transistor UT for data side driver IC40 employs a P-ch MOSFET or PNP-transistor, even if the data side electrode becomes negative when the transistor UT is turned off, base current does not flow because the parasitic diode disposed between the base and the emitter is arranged to be in the inverse direction, whereby the transistor UT remains turned off and no collector current flows.

As described above, according to the embodiment of the present invention, a driving circuit for a thin film EL display circuit can be provided in which even though the conventional advantages are retained, the level of consumption of electricity for which modulation accounts for most of the driving electricity (substantially 70%) can be reduced by half. This achievement can be obtained by reusing the modulation charge stored in the thin film EL device after it has emitted light.

What is claimed is:

1. A driving circuit for a thin film electroluminescent (EL) display device wherein an (EL) layer is disposed between orthogonally arranged scanning electrodes and data electrodes the driving circuit comprising:

scanning side driver means, connected to said scanning electrodes, for selectively applying negative and positive voltages to said scanning electrodes, said scanning side driver means including scanning switching circuits for selectively applying writing voltages or 0 V to a common line of the scanning side driver switching circuits;

data side driver means, connected to said data electrodes for selectively charging and discharging the data side electrodes, said data side driver means including a data switching circuit associated with each data electrode for applying modulation voltage to said associated electrode; and modulation voltage development and conservation means for developing said modulation voltage for charging selected data electrodes in a stepwise manner to reduce power consumption, and for, during discharge of said selected data electrodes, absorbing a portion of charge obtained from said data electrodes during the discharge thereof, said absorbed charge being reusable to further reduce power consumption.

2. The driving circuit of claim 1, wherein the scanning side driver means comprises two drivers driving odd number lines and even number lines of the scanning electrodes respectively.

3. The driving circuit of claim 2, wherein each said data switching circuit includes, first and second transistors connected in series between positive and negative voltage supplies, with its corresponding said data electrode connected between for applying positive and negative voltages to the data electrodes, first and second diodes connected across said first and second transistors and passing an electric current in the inverse direction to their respective transistor paths.

4. The driving circuit of claim 3 wherein the scanning side driver means have logical circuits for driving the first and second two sets of transistors.

5. The driving circuit of claim 3, wherein each of the first transistors is selected from a group consisting of a Pch-MOSFET, a thyristor and a PNP-transistor;

one side of each first transistor being connected to a modulation power source, and providing a pull-up function, and each of the second transistors being selected from a group consisting of a Nch-MOSFET, a thyristor and a NPN transistor, one side of each second transistor being grounded and providing a pull down function.

6. The driving circuit of claim 5, wherein each of said data side electrodes is further connected to diodes for passing electric current in the reverse direction to the corresponding first and second switching elements.

7. The driving circuit of claim 5, wherein each pair of first and second transistors are controlled by a logical circuit in the data side driver means.

8. The driving circuit of claim 1 wherein said modulation voltage development and conservation means includes a charge storage capacitor for collecting said absorbed charge.

9. The driving circuit of claim 8 wherein said modulation voltage development and conservation means includes a voltage doubler for developing said modulation voltage in a stepwise manner, said charge storage capacitor being part of said voltage doubler and thereby aiding in the generation of a stepwise voltage waveform and the collecting of said absorbed charge.

10. The driving circuit of claim 9, wherein said capacitor of said modulation voltage development and conservation means is charged by a ½ modulation voltage, said voltage doubler supplying a modulation voltage Vm to the data side driver means to cause selected portions of the EL display device to emit light.

11. The driving circuit of claim 3 wherein said logical circuits are shift registers.

12. The driving circuit of claim 7 wherein said logical circuits are shift registers.

13. A driving circuit for a thin film electroluminescent (EL) display device wherein an EL layer is disposed between scanning electrodes and data electrodes which are arranged at a right angle to the scanning electrodes, the driving circuit comprising, a scanning side driver for sequentially applying a positive voltage or a negative voltage to the scanning electrodes;

a data side driver for applying a modulation voltage Vm or 0 V to each of the data electrodes; and a power driver for supplying the voltage Vm to the data side driver;

the power driver including, a capacitor, means for selectively connecting the capacitor in parallel or in series with a power source generating half of the voltage Vm, means for stepwise supplying the voltage Vm generated by the power source and by the series connection of the capacitor and the power source to the data side driver to charge said data electrodes with reduced power consumption, and means for returning charge stored between the data electrodes applied with the voltage Vm and the data electrodes applied with 0 V to the capacitor connected in parallel with the power source.

14. A driving circuit for a thin film electroluminescent (EL) display device wherein an EL layer is disposed between scanning electrodes and data electrodes which are arranged at a right angle to the scanning electrodes, the driving circuit comprising, a scanning side driver for sequentially applying a positive voltage or a negative voltage to the scanning electrodes;

a data side driver for applying a modulation voltage Vm or 0 V to each of the data electrodes; and a power driver for supplying the voltage Vm to the data side driver;

the power driver including, a first switch and a second switch connected in series with each other, and coupled in parallel with a power source generating half of the voltage Vm, a first diode and a third switch coupled in parallel with each other, a capacitor coupled between a first diode node and the common node of the first switch and the second switch, and a second diode coupled in parallel with the series connection of the capacitor and the first switch.

15. A method of utilizing a voltage doubler in energy efficiently driving a matrix electroluminescent (EL) display panel having orthogonally arranged electrodes and sandwiching an electroluminescent material, said voltage doubler including a capacitor, a voltage source developing a voltage ½ Vm and means for selectively switching said capacitor and voltage source in series or parallel to develop a desired modulation voltage Vm for supply to said electrodes equal to twice the voltage ½ Vm of said voltage source, said method comprising:

(a) charging said capacitor to said voltage ½ Vm by switching said capacitor and voltage source in parallel;

(b) supplying said voltage ½ Vm from said voltage source to said electrodes to charge said electrodes to ½ Vm;

(c) switching said capacitor charged to said voltage ½ Vm in series with said voltage source to develop a desired modulation voltage Vm;

(d) supplying said desired modulation voltage Vm to said electrodes to charge said electrodes to Vm;

(e) connecting said electrodes charged to Vm in parallel with said capacitor and said voltage source during said step of charging to utilize the charged voltage Vm to charge said capacitor;

(f) repeating said steps (a)–(e) to drive said electrodes;

said steps (a)–(d) supply the modulation voltage Vm to said electrodes in a stepwise manner to reduce the energy consumed during charging;

said step (e) reusing charge supplied to said electrodes to further reduce energy consumption.

16. The method of claim 15 wherein a diode is provided for supplying charge from said charged electrodes to said capacitor to perform step (e) is conjunction with the voltage difference between the electrodes charged to the desired modulation voltage and said capacitor having a lower voltage thereacross.

17. The method of claim 15 wherein said electrodes are data electrodes.

* * * * *